United States Patent [19]

Bibollet

[11] Patent Number: 4,692,097

[45] Date of Patent: Sep. 8, 1987

[54] PROPELLER WITH REMOVABLE AND ADJUSTABLE BLADES

[75] Inventor: Bernard Bibollet, Cesson La Foret, France

[73] Assignee: Fonderie Musil, Dammarie Les Lys, France

[21] Appl. No.: 878,304

[22] Filed: Jun. 25, 1986

[30] Foreign Application Priority Data

Jun. 26, 1985 [FR] France ..... 85 10367

[51] Int. Cl.[4] ..... B63H 3/12; B64C 11/06

[52] U.S. Cl. ..... 416/207; 416/205

[58] Field of Search ..... 416/204–207, 416/174

[56] References Cited

U.S. PATENT DOCUMENTS

| | | | |
|---|---|---|---|
| 945,663 | 1/1910 | Yeager | 416/207 |
| 1,808,888 | 6/1931 | Fahlin | 416/207 |
| 1,875,606 | 9/1932 | Houston | 416/207 |
| 2,307,490 | 1/1943 | Curley | 416/207 |
| 2,315,574 | 4/1943 | Anderson | 416/205 |
| 2,652,123 | 9/1953 | Kearns | 416/205 |
| 3,123,145 | 3/1964 | Byrd | 416/207 |
| 3,255,827 | 6/1966 | Nichols | 416/207 X |
| 3,357,496 | 12/1967 | Petersen | 416/207 |
| 3,490,537 | 1/1970 | Quenneville | 416/205 X |
| 3,594,099 | 7/1971 | Herbert | 416/207 |

FOREIGN PATENT DOCUMENTS

| | | | |
|---|---|---|---|
| 367265 | 2/1932 | United Kingdom | 416/207 |

*Primary Examiner*—Everette A. Powell, Jr.

*Attorney, Agent, or Firm*—Karl F. Ross; Herbert Dubno; Andrew Wilford

[57] ABSTRACT

A propeller according to the invention has a hub centered on and rotatable about a hub axis and formed with a bore extending along the axis and with a plurality of identical, radially outwardly open, and angularly equispaced sockets centered on socket axes extending at least generally radially of the hub axis. Respective identical blades each have a base complementary to and snugly fittable in the respective socket and an outer part extending radially outward from the hub along the respective socket axis when the respective base is fitted therein. Respective locks are provided in the hub for releasably fixing the bases in the respective sockets against relative movement between the respective blades and the hub. The sockets and bases are normally complementarily cylindrical and both centered when the bases are in the sockets on the respective socket axes. Thus the blades can turn about the respective socket axes on the hub when released by the respective locking means. In addition each socket is formed with an annular groove open inwardly radially of the respective socket axis and each base is formed with a similar annular but outwardly open groove confronting the respective inwardly open groove when the base is fitted in the respective socket and forming with the respective inwardly open groove an annular chamber. The system for locking includes a respective plurality of balls generally filling the chamber and something that can press the balls tightly against the respective grooves.

7 Claims, 5 Drawing Figures

PROPELLER WITH REMOVABLE AND ADJUSTABLE BLADES

FIELD OF THE INVENTION

The present invention relates to a propeller. More particularly this invention concerns a propeller with removable blades used for instance as a watercraft drive screw, mixer element, turbine rotor, air fan, or the like.

BACKGROUND OF THE INVENTION

A standard propeller such as usable as the drive screw of a watercraft comprises a central hub centered on and normally rotated about a hub axis, and a plurality of identical blades extending radially at equiangular spacing from the hub. Such a propeller is invariably made by casting from one piece of metal, either stainless steel or a cuproaluminum alloy, as it must be very strong and must also be capable of being finished to very close tolerances.

The rough casting from which the propeller is eventually made is cast in a mold that is made from a model supplied to the foundry either in wood or in metal. The wood model normally has a single blade but the metal one is complete.

The wood-model route is most popular because the model costs the least to make. The foundry has to make up individual molds for each blade. In this there is a possibility of modifying the pitch by inclining the axis of the propeller hub relative to the original setting, but this possibility is limited and anyhow the new value of the pitch is really only obtained on a single radius normally equal to seven-tenths of the radius of the propeller.

Once the rough casting for a given propeller is completed it is subject to a complex and expensive machining operation that must be carried out by hand by skilled workers. The propeller must be ground and eventually statically and even dynamically balanced. As a result a propeller is expensive to manufacture. In addition propellers must also normally be produced in a wide range of sizes.

It is fairly common for a propeller to be damaged, in particular in inland waterways, so that the propeller must either be repaired or replaced. Repair is extremely exacting work, and replacement is also expensive because of how much a propeller costs to make in a group of different sizes and then to stock in this range of sizes.

It is also common that a change in engine or operating conditions requires that a different type of propeller be used. In this situation a perfectly good propeller must be replaced with the needed type, or inferior operating performance with the existing but now mismatched propeller must be tolerated.

OBJECTS OF THE INVENTION

It is therefore an object of the present invention to provide an improved propeller.

Another object is the provision of such a propeller which overcomes the above-given disadvantages, that is which is inexpensive to manufacture and which is not difficult to adapt to a range of sizes.

SUMMARY OF THE INVENTION

A propeller according to the invention has a hub centered on and rotatable about a hub axis and formed with a bore extending along the axis and with a plurality of identical, radially outwardly open, and angularly equispaced sockets centered on socket axes extending at least generally radially of the hub axis. Respective identical blades each have a base complementary to and snugly fittable in the respective socket and an outer vane part extending radially outward from the hub along the respective socket axis when the respective base is fitted therein. Respective locks are provided in the hub for releasably fixing the bases in the respective sockets against relative movement between the respective blades and the hub. The sockets and bases are normally complementarily cylindrical and both centered when the bases are in the sockets on the respective socket axes. Thus the blades can turn about the respective socket axes on the hub when released by the respective locking means. In addition each socket is formed with an annular groove open inwardly radially of the respective socket axis and each base is formed with a similar annular but outwardly open groove confronting the respective inwardly open groove when the base is fitted in the respective socket and forming with the respective inwardly open groove an annular chamber. The system for locking includes a respective plurality of balls generally filling the chamber and something that can press the balls tightly against the respective grooves.

According to further features of this invention the hub is formed at each socket with a loading passage having an outer outwardly open and threaded end and an inner end opening at the respective inwardly open groove and each passage is sufficiently large that balls can be introduced through it into the respective chamber. The means for pressing the balls are screwed into the respective outer ends to bear on the balls therein. A plug is threaded into the outer end of each passage and bears on a locking ball that in turn bears on two of the respective set of balls. This presses the balls apart and wedges them in the respective chamber thereby solidly locking the blade in the socket. When not under such compression each set of balls acts like a rotary roller bearing to permit the respective blade to rotate in the respective socket.

Each socket in accordance with this invention has a face directed radially outward from the hub axis and each blade has a face directed radially inward toward the hub axis and directly confronting the respective socket face when the respective blade base is fitted in the respective socket. At least one stop pin projects radially of the hub axis at each socket from one of the respective faces into the other respective face. This locks each blade against rotation relative to its socket even if the locking balls are not under compression. The use of a pin like this allows exact pitches to be set by aligning factory-precise bores and pins. Normally a given blade is only meant for use at a given pitch, so the correct setting can be established at the factory, although a series of holes on either face would allow for some range of adjustability through a series of accurately determined positions.

To allow the system to be emptied of balls or the balls to be freed up after they have been compressed to lock a blade, the hub is formed at each socket with another passage offset from the respective loading passage, opening into the respective chamber, and normally blocked by a respective plug. A tool or a fluid under pressure could be admitted to the chamber through this passage to free up or push the balls out the other passage which is unblocked. This other passage can be of larger diameter than the chamber, and the auxiliary locking ball in this passage can be similarly large to facilitate filling and emptying of each chamber.

Furthermore seals are provided between each plug and the respective passage and between each socket and the respective base when fitted therein to prevent leakage therebetween. These seals also allow the joints between the base and socket to be greased.

A main advantage of this invention is that both the hub and the blades can be made very inexpensively. A crude casting of the hub can be finished entirely by turning and boring, machine operations that can be automated and carried out by relatively unskilled operators. Even most of the work on a blade is similarly reduced to turning and boring, as compared to the hand milling of the prior art, for relatively inexpensive manufacture.

Furthermore a small series of differently sized hubs can be combined with a small series of differently sized blades to produce virtually any desired propeller size with any desired number of blades. To make up a given propeller size a chart is consulted so that the blade and hub can be selected, whereupon they can be put together using parts—balls and plugs mainly—that are standard for all propeller sizes.

Even at the foundry it is possible to cut down long blades to make short blades if the socket and base sizes are standardized. The initial model can also be simplified, as only one blade model need be made for each of the different sizes needed. The original casting can also be made to much tighter tolerances than has been the case hitherto, because the parts are fairly simple castings. In fact the vane parts of the blades can be cast so that once scraped and shot-peened they merely need some milling to get them to the right weight and pitch. The system of the invention therefore greatly simplifies the problems of manufacturing and maintaining a stock of propellers.

DESCRIPTION OF THE DRAWING

The above and other features and advantages will become more readily apparent from the following, reference being made to the accompanying drawing in which.

SPECIFIC DESCRIPTION

Figure 1:
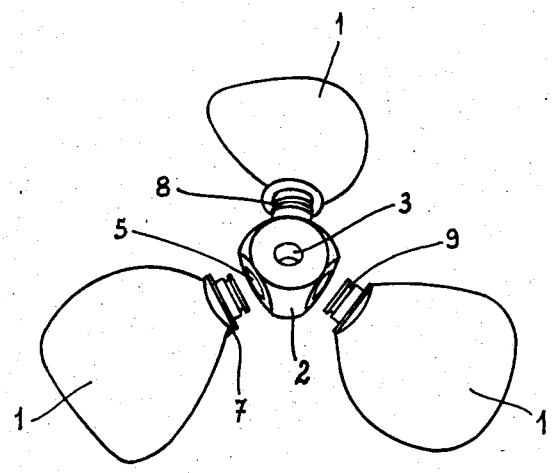
FIG. 1 is an exploded perspective view of a propeller according to this invention.

As seen in FIG. 1 a propeller according to this invention has three identical blades 1 and a single hub 2, although of course more or fewer than three blades is of course possible.

The hub 2 is a massive metal casting formed with a central bore 3 centered on a hub axis 4. It has a pair of axially opposite faces 12 and 17 and is formed with three identical sockets 5 of cylindrical shape centered on respective socket axes $A_5$ that extend perpendicularly from a common point on the axis 4 and that are angularly equispaced about this axis 4. Each socket 5 is further formed at around its midlength point with an annular groove 6 that opens radially inward is of semicircular section. Extending in one direction parallel to the hub axis 4 from the groove 6 to the face 12 is a large-diameter threaded passage 11. A smaller-diameter threaded passage 16 extends in the opposite direction from the groove 6 to the other face 17.

The blades 1 each extend along respective blade axes $A_1$ and have at one axial end a cylindrical base 8 complementary to any of the identical sockets 5 and centered on the respective axis $A_1$. Each base 8 is formed with a radially outwardly open semicircular-section groove 9 substantially identical to any of the identical grooves 6.

Figure 2:
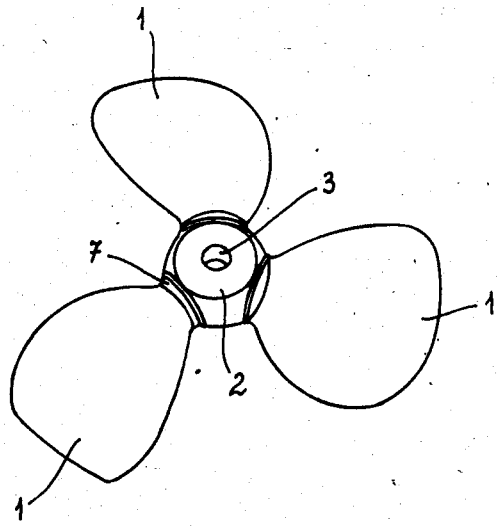
FIG. 2 is a perspective view of the assembled propeller.
Figure 3:
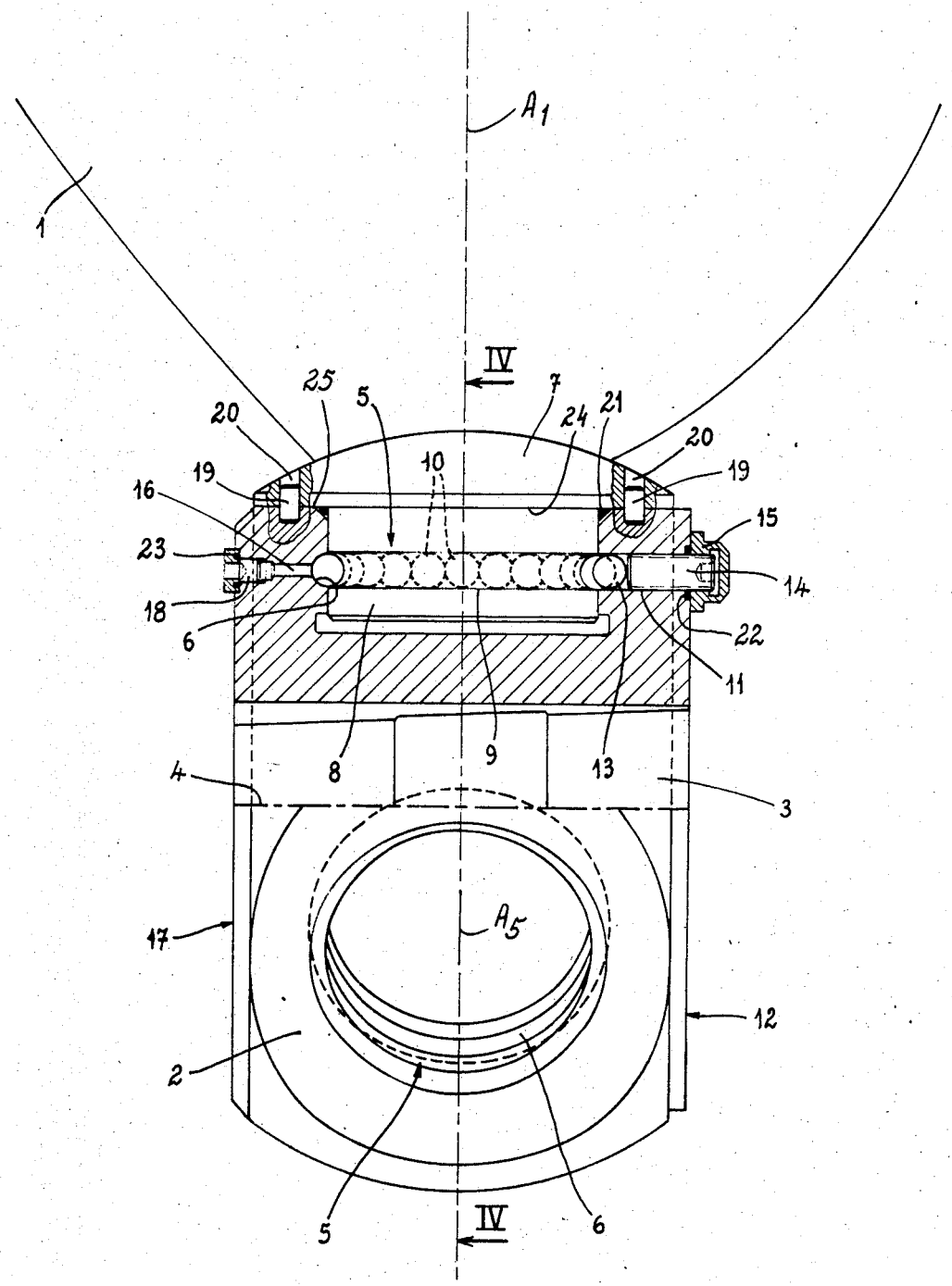
FIG. 3 is a large-scale section taken along a blade axis through the propeller hub.
Figure 4:
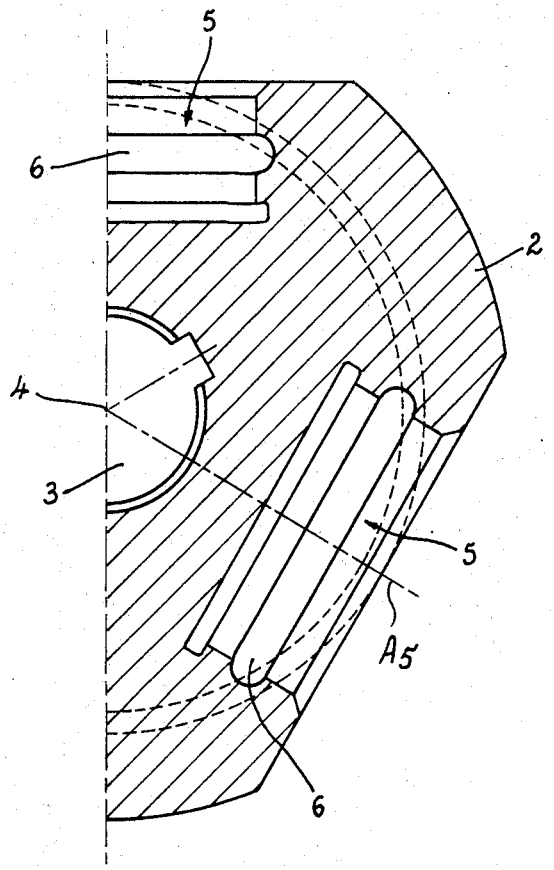
FIG. 4 is a section taken along line IV—IV of FIG. 3.
Figure 5:
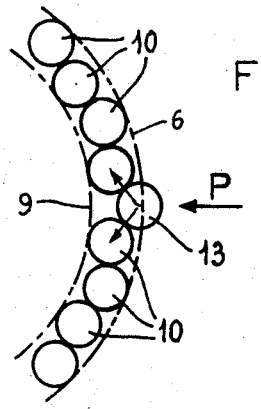
FIG. 5 is a largely schematic detail view illustrating how the blade lock works.

Thus as seen in FIGS. 1 and 2 each blade 1 can be fitted to a respective socket 5 of the hub 2 by moving it along the respective socket axis $A_5$ until the base 8 is seated in the socket 5 with the grooves 6 and 9 aligned.

In addition the hub 2 is formed around each socket 5 with a respective annular and planar face 25 perpendicular to the respective axis $A_5$ and each base 8 springs from a shoulder portion 7 formed with an annular face 24 perpendicular to the respective axis $A_1$ and centered thereon. The shoulder 8 is axially traversed by at least two bores 20 that open at the face 24 spaced angularly about the axis $A_1$ from each other. Pins 19 project outward from the axis 4 and along the axis $A_5$ from the face 25 and can fit into the holes 20 to lock a blade 1 fitted to a socket 5 against relative rotation about the now coaxial respective axes $A_1$ and $A_5$.

The blades 1 are fixed in the hub 2 against displacement along the respective axes $A_1$ from the hub axis 4 by respective pluralities of substantially identical steel balls 10 filling the chambers formed by the juxtaposed grooves 6 and 9 of each socket 5. Each passage 11 houses another ball 13 which is pressed radially of the axes $A_1$ and $A_5$ as indicated by arrow P between two adjacent balls 10 of the respective set by a respective plug 14 threaded into the outer end of the passage 11. Thus pushes half the balls 10 of the respective set in one angular direction and the other half in the opposite one, wedging these balls 10 tightly between the grooves 6 and 9 and thereby solidly locking the respective blade 1 in the respective socket 5. If the balls 10 are somewhat undersized they will wedge alternately against opposite sides of the passage 6, 9 for very uniform holding of the blades 1 on the hub 2. Thus once a blade 1 is fitted in the desired angular setting to produce the desired pitch it can be locked solidly in place by screwing in the respective plug 14. A cap 15 can be threaded over the projecting threaded end of this screw 14 to engage the face 12 of the hub 2 and, like a locknut, prevent it from loosening.

The opposite passage 16 from each groove 6 is too small to let the balls 10 through and is normally blocked by a screw plug 18 so as to be used to admit something to free and/or remove the balls 10 if subsequently it is necessary to adjust or remove the blade 1. For adjustment it is merely necessary to back off the screw 14 and then free up the balls 10, as for instance by poking a pointed rod into the hole 16 to push the balls 10 back toward the now retracted ball 13. Once thus loosened the blade 1 can rotate about the respective socket axis $A_5$ so long as the pins 10 have been retracted. To empty the balls 10 out of the joint for complete removal of the respective blade the plug 14 is removed completely and compressed air or high-pressure water can be injected into the opposite passage 16 to flush the thus loosened balls 10 out the open passage 11. Once all the balls 10 are out, the blade 1 can be pulled axially out of the socket 5.

In addition the entire joint can be lubricated with a heavy grease via the hole 11 or 16. To maintain such a body of lubricant inside the assembly, a seal 21 is provided at the inside peripheries of the faces 24 and 25, a seal 22 is provided around the plug 14, and another seal 23 is provided around the screw plug 18.

The propeller according to this invention can of course be used as the rotor of either a motor or a pump. It could be used on a kneading or mixing machine, or anywhere it is necessary to have a plurality of blades on a normally rotating hub for transmission of mechanical energy between torque in the hub and movement in a fluid moving through the propeller past its blades.

I claim:

1. A propeller comprising:

a hub centered on and rotatable about a hub axis and formed with a bore extending along the axis and with a plurality of identical, radially outwardly open, substantially cylindrical, and angularly equispaced sockets centered on socket axes extending at least generally radially of the hub axis and formed with an annular groove open inwardly radially of the respective socket axis;

respective identical blades each having a substantially cylindrical base complementary to and snugly fittable in the respective socket coaxial with the respective socket axis and an outer part extending radially outward from the hub along the respective socket axis when the respective base is fitted therein, whereby the blades can turn about the respective socket axes on the hub, each base being formed with an annular but outwardly open groove confronting the respective inwardly open groove when the base is fitted in the respective socket and forming with the respective inwardly open groove an annular chamber, the hub being formed at each socket with a substantially radially extending loading passage having an outer outwardly open and threaded end and an inner end opening at the respective inwardly open groove; and lock means including:

a respective annular array of holding balls generally filling each chamber, each passage being sufficiently large that balls can be introduced through it into the respective chamber, a respective locking ball radially displaceable in each passage and engageable between two of the holding balls of the respective array, and means screwed into the outer end of each passage for pressing the locking ball radially between the respective two holding balls and for thereby releasably locking the bases in the respective sockets against relative movement between the respective blades and the hub and pressing the respective holding balls against the respective grooves.

2. The propeller defined in claim 1 wherein the hub is provided at each socket with an annular seal engaged between each socket and the respective base when fitted therein to prevent leakage therebetween.

3. The propeller defined in claim 1 wherein the hub is formed at each socket with another passage offset from the respective loading passage, opening into the respective chamber, and normally blocked by a respective plug.

4. The propeller defined in claim 1 wherein each means for pressing is a plug threaded in the respective outer end.

5. The propeller defined in claim 4, further comprising a respective seal ring between each plug and the respective passage for preventing leakage therebetween.

6. The propeller defined in claim 1 wherein the each socket has a face directed radially outward from the hub axis and each blade has a face directed radially inward toward the hub axis and directly confronting the respective socket face when the respective blade base is fitted in the respective socket, the propeller further comprising a stop pin projecting radially of the hub axis at each socket from one of the respective faces into the other respective face.

7. The propeller defined in claim 6 wherein the faces are all annular and planar.

* * * * *